US006293621B1

(12) United States Patent
Marsh et al.

(10) Patent No.: US 6,293,621 B1
(45) Date of Patent: Sep. 25, 2001

(54) GRAVITY LIFT CHAIR

(75) Inventors: Donald C. Marsh; Gregory L. Buckner, both of Hillsborough County, FL (US)

(73) Assignee: All Star Bleachers, Lakeland, FL (US)

( * ) Notice: Subject to any disclaimer, the term of this patent is extended or adjusted under 35 U.S.C. 154(b) by 0 days.

(21) Appl. No.: 09/326,724

(22) Filed: Jun. 7, 1999

(51) Int. Cl.[7] ..... A47C 1/02
(52) U.S. Cl. ..... 297/335; 297/248
(58) Field of Search ..... 297/452.18, 452.57, 297/452.55, 331, 335, 336, 232, 248

(56) References Cited

U.S. PATENT DOCUMENTS 1,029,821 * 6/1912 Patterson .
3,077,364 * 2/1963 Eppink .
3,850,476 * 11/1974 Day .
3,889,999 * 6/1975 Mackintosh .
4,630,867 * 12/1986 Gulliver .
5,375,914 * 12/1994 Donnelly .
5,899,531 * 5/1999 Koehler .

* cited by examiner

*Primary Examiner*—Milton Nelson, Jr.
(74) *Attorney, Agent, or Firm*—Arthur W. Fisher, II

(57) ABSTRACT

A chair for use with a plurality of such chairs arranged in rows to provide an aisle between adjacent rows of chairs when the chairs are not in use comprising a frame assembly configured to operatively support a seat assembly including a seat movable between a raised or upright position when not in use and a lowered or deployed position when in use and a seat positioning assembly coupled to the seat to normally maintain the seat in the raised or upright position.

12 Claims, 8 Drawing Sheets

GRAVITY LIFT CHAIR

BACKGROUND OF THE INVENTION

1. Field of the Invention

A chair for use with a plurality of such chairs arranged in rows to provide an aisle between adjacent rows of chairs when the chairs are not in use.

2. Description of the Prior Art

Numerous theater and stadium seats or chairs have been developed to allow assess to such seats and chairs when arranged in a plurality of rows.

U.S. Pat. No. 3,347,593 is directed to spectator seating adjustable for the comfort of the spectator where the seats in each row are staggered so as to provide proper spectator viewing.

U.S. Pat. No. 3,889,999 shows the seat bottom for each of a row of chairs is hingedly connected between spaced standards supporting the seat backs and arms. Brackets with pivot arms are located on opposite sides of the seat bottom to receive each standard extending toward each seat bottom.

U.S. Pat. No. 4,133,579 relates to a seat therefor including top and bottom walls merging with front, rear and a pair of opposite side walls. The seat is a one-piece homogenous plastic blow-molded construction with a parting line along the front, rear and pair of opposite side walls. Portions of the top and bottom walls are compression fused to each other adjacent the side walls to form reinforced areas adapted for securement to a conventional chair seat support bracket.

U.S. Pat. No. 3,077,364 teaches a seating structure for a stadium foundation having step faces compiling a plurality of seat members; a plurality of standards; securing means extending substantially uniformly along the length of each step face; an element for each of said standards cooperating with said securing means at any position therealong and rigidly securing the corresponding standard at any desired position along the step face. The entire row of seats may be adapted to length variations. The securing means comprise a groove formed in the step face the mouth of which has a height less than the maximum height of the groove in which the companion element is a clamp comprising a member having a first part received in the groove and a second part projecting out of the groove, and means reacting against the second part and the standard for clamping the standard against the step face while the first part is caused to engage the groove.

U.S. Pat. No. 3,194,601 relates to a platform providing stepped vertical and horizontal areas, pedestals anchored to a vertical portion of the platform, a cross beam carried by said pedestals, a pair of back tubes fixed to the beam having portions extending rearwardly and upwardly and short portions extending forwardly, a plastic back carried by the upwardly-extending tube portions and providing also a rear seat segment over the forwardly-extending portions. A pair of seat supports are pivotally mounted on the forwardly-extending tube portions. A plastic seat segment complementary to the first-mentioned rear seat segment is carried by the seat supports. A spring means yieldably urging the forward seat segment upwardly into a position generally parallel with the back the forward seat segment being apertured to clear the forwardly-extending back tube portions when the forward seat segment is raised and the fixed rear seat segment being provided with extensions received within the apertures to substantially fill the apertures when the forward seat segment is in lowermost position.

Additional examples of the prior art are found in U.S. Pat. No. 2,146,310; U.S. Pat. No. D347,947; U.S. Pat. No. D347,332; U.S. D190,230; GB 10,358; GB 211,050 and CH 124,724.

SUMMARY OF THE INVENTION

The present invention relates to a chair for use in stadiums, theaters and similar venues. More specifically, the chair is intended for use with a plurality of such chairs arranged in rows to provide an aisle or walkway between adjacent rows of chairs when the chairs are not in use.

As described more fully hereinafter, the chair comprises a frame assembly configured to operatively support a seat assembly including a back support member and a seat movable between a raised or upright position when not occupied and a lowered or deployed position when occupied and a seat positioning assembly coupled to the seat to normally maintain the seat in the raised or upright position.

The frame assembly comprises a pair of substantially parallel side frames each including an upright frame member having a corresponding seat support member affixed thereto to operatively support the a back support member and seat respectively therebetween. Specifically, the back support member is affixed between the upper portions of the upright frame members; while, the seat is pivotally coupled between the corresponding seat support members.

The seat positioning assembly comprises a pair of spaced apart substantially parallel seat positioning members and a counter weight affixed for the lower surface of the seat.

When assembled, rows of the chairs are closely spaced in front to back relationship as typically found in a stadium or theater. Each row of chairs comprises a plurality of such chairs in side to side relationship relative to each other.

When the chairs are not occupied, the counter weight of each seat positioning assembly maintains the corresponding seat in the raised or upright position permitting persons to walk between adjacent rows. When occupied, the weight of the person on the seat overcomes the counter weight of corresponding seat positioning assembly to maintain the seat in the lowered or deployed position to so long as the chair is occupied. So positioned, the aisle or walkway is relatively obstructed. Once the chair is no longer occupied, the counter weight of the corresponding seat positioning assembly causes the corresponding seat to return to the raised or upright position again opening the aisle or walkway for foot traffic.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
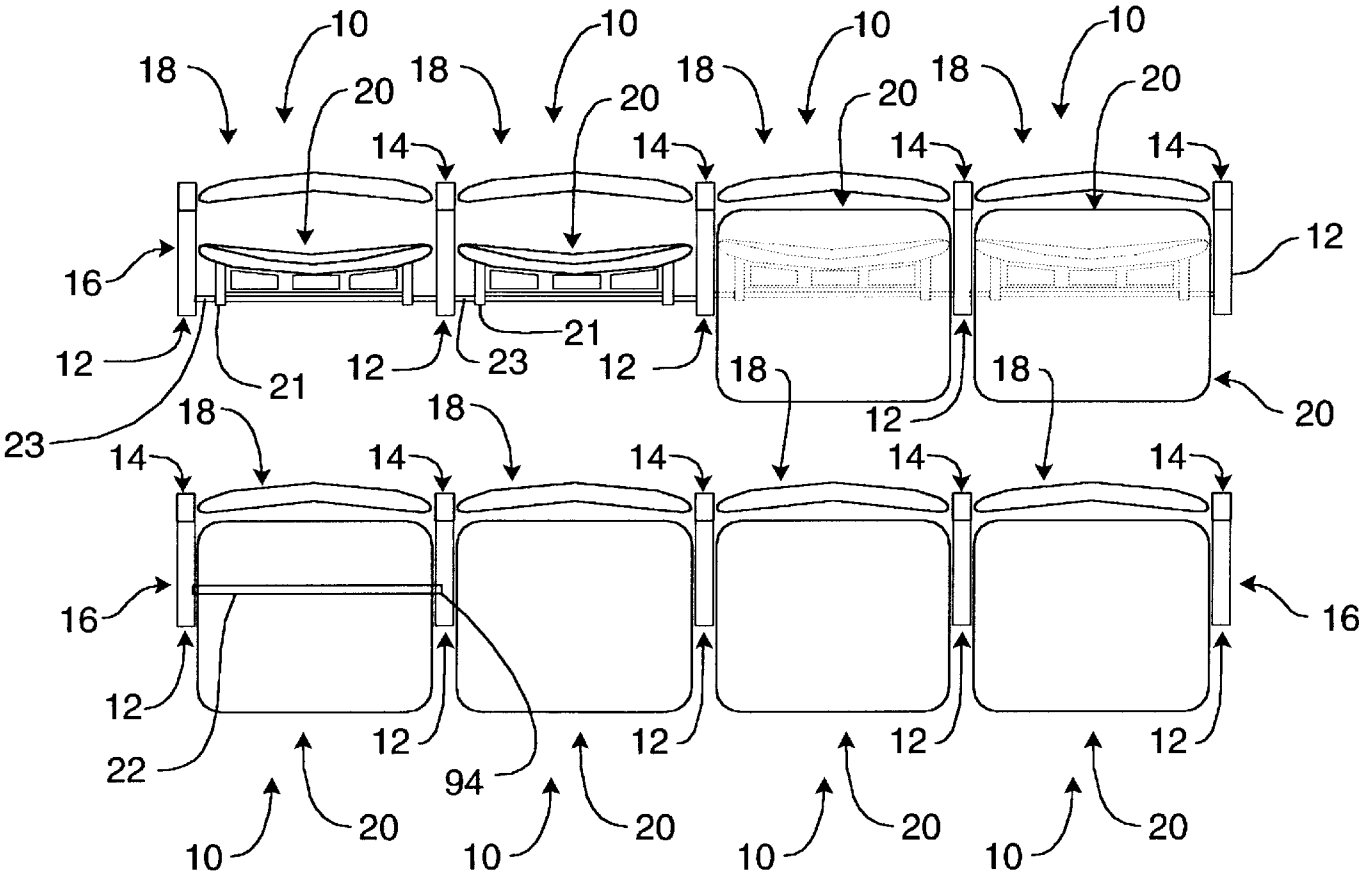
FIG. 1 is a perspective view of a row of the chairs of the present invention.

As shown in FIG. 1, the present invention relates to a chair generally indicated as 10 arranged in rows to provide an aisle or walkway between adjacent rows for foot traffic therethrough. Each chair 10 comprises a frame assembly including a pair of spaced apart substantially parallel side frames each generally indicated as 12 having an upright frame member generally indicated as 14 with a corresponding seat support member generally indicated as 16 affixed thereto, a seat assembly including a back support generally indicated as 18 extending between the upper portions of the corresponding upright frame member 14 and a seat generally indicated as 20 pivotally coupled between corresponding seat support members 16 and a seat positioning assembly including a pair of spaced apart substantially parallel seat positioning members each generally indicated as 21 a transverse seat positioning transverse seat positioning counter weight 22 and a support member or rod 23 to normally maintain the seat 20 in a raised or upright position as shown in the right side of FIG. 1.

Figure 2:
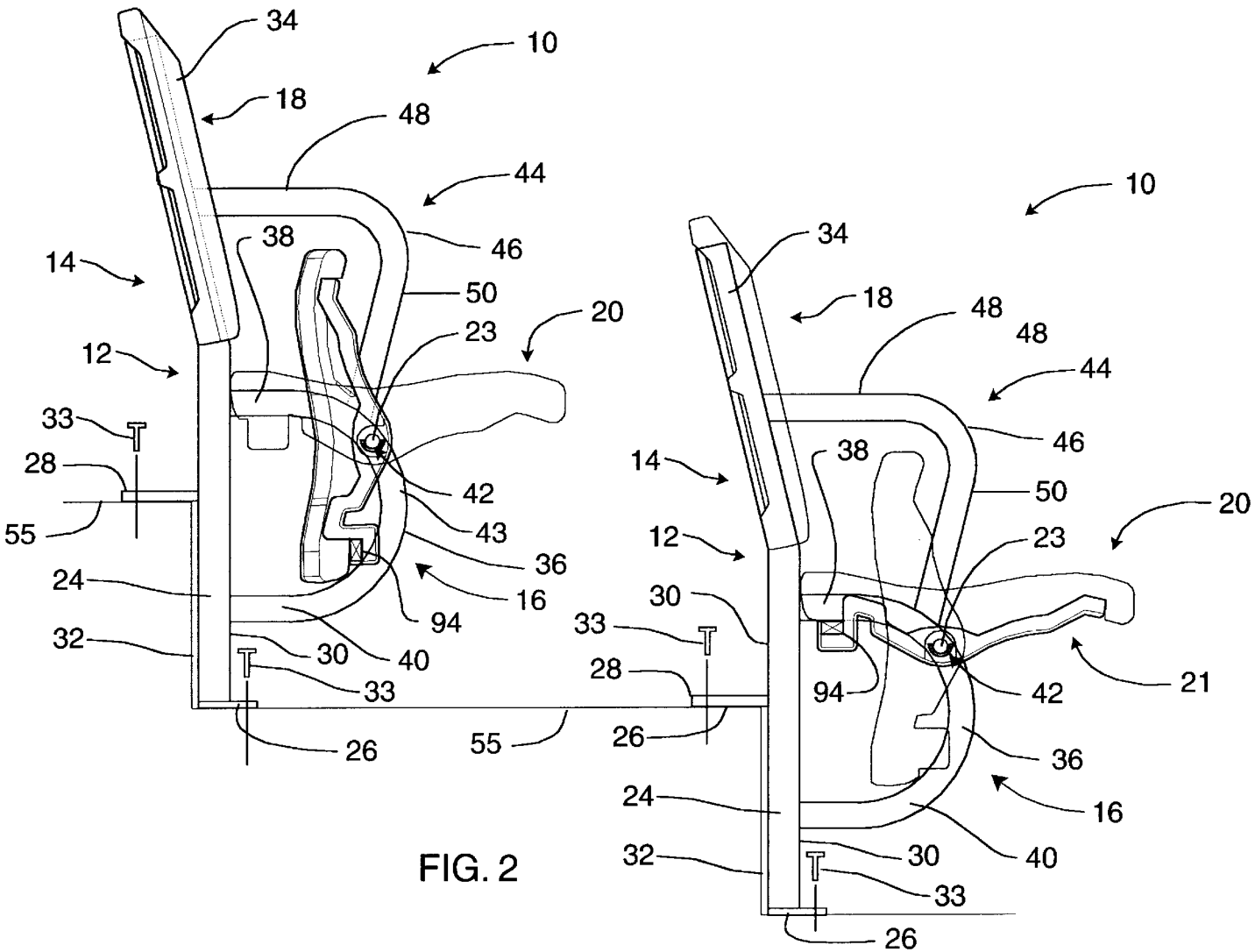
FIG. 2 is a side view of the side frame of the present invention.

As best shown in FIGS. 1 and 2, each upright frame member 14 comprises a substantially vertical lower stanchion section 24 having a lower and upper mounting element or tab indicated as 26 and 28 respectively extending outwardly from the front and rear surfaces indicated as 30 and 32 respectively of the lower and upper portions respectively thereof to secure the corresponding spaced apart substantially parallel side frames 12 to a support structure SS by fasteners such as rivets 33 and an upper stanchion section 34 inclined rearwardly from the upper portion of the substantially vertical lower stanchion section 24.

As best shown in FIGS. 1 and 2, each seat support member 16 comprises an arcuate or convex outer seat support section 36 affixed to the front surface or side 30 of the substantially vertical lower stanchion section 24 by substantially horizontal parallel first and second interconnecting seat support sections indicated as 38 and 40 respectively extending outwardly from the front surface or side 30 of the substantially vertical lower stanchion section 24 of the upright frame member 14. A seat support element generally indicated as 42 is formed on the inner surface 43 of each arcuate or convex outer seat support section 36 to pivotally support the seat 20 thereon by supporting the opposite end portions of the support member or rod 23.

As best shown in FIGS. 1 and 2, an arm rest generally indicated as 44 may be affixed to each side frame element 12. Specifically, each arm rest 44 comprises an arcuate or convex outer arm rest section 46 affixed to the upright frame member 14 by a first interconnecting arm rest section 48 and to the seat support member 16 by a second interconnecting arm rest section 50.

Figure 3:
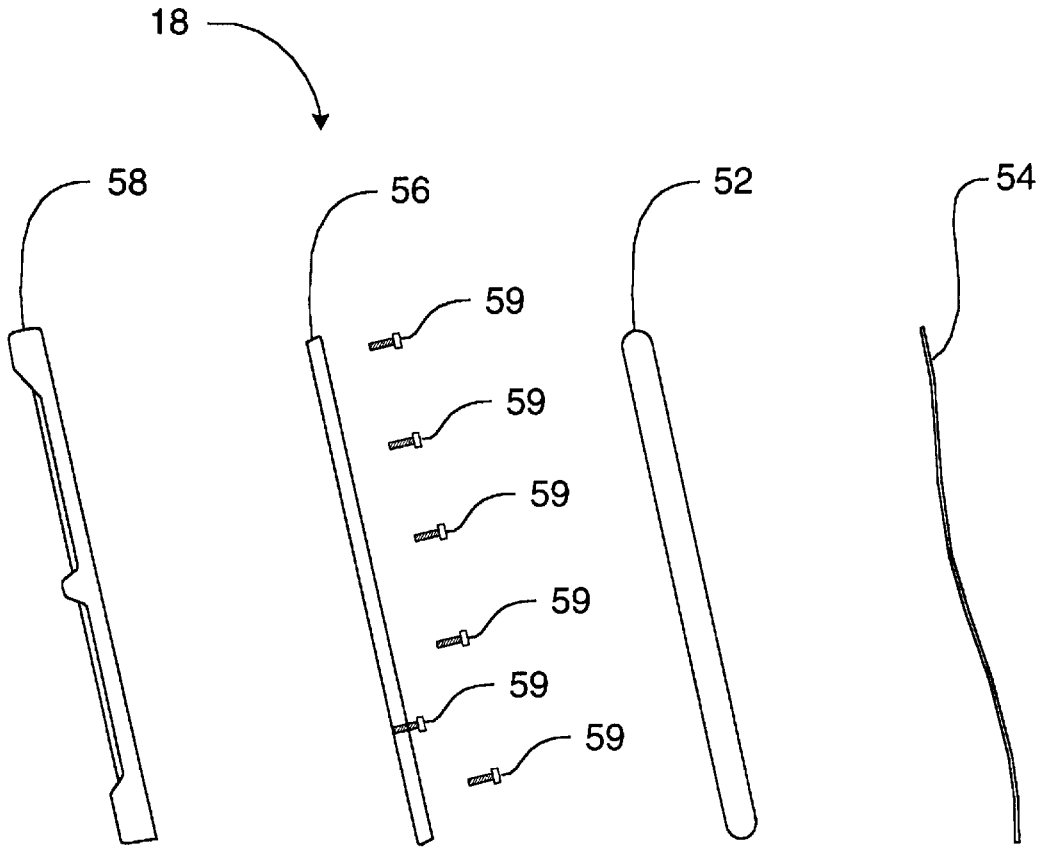
FIG. 3 is an exploded side view of the back support of the present invention.

As best shown in FIG. 3, the back support 18 of each chair 10 comprises a foam cushion section 52 disposed between a flexible outer convering 54 and an inner backing 56 operatively attached to a rigid back member 58 by a plurality of fasteners such as rivets each indicated as 59. Each back support 18 is secured between upper stanchion section 34 of adjacent side frames 12.

Figure 4:
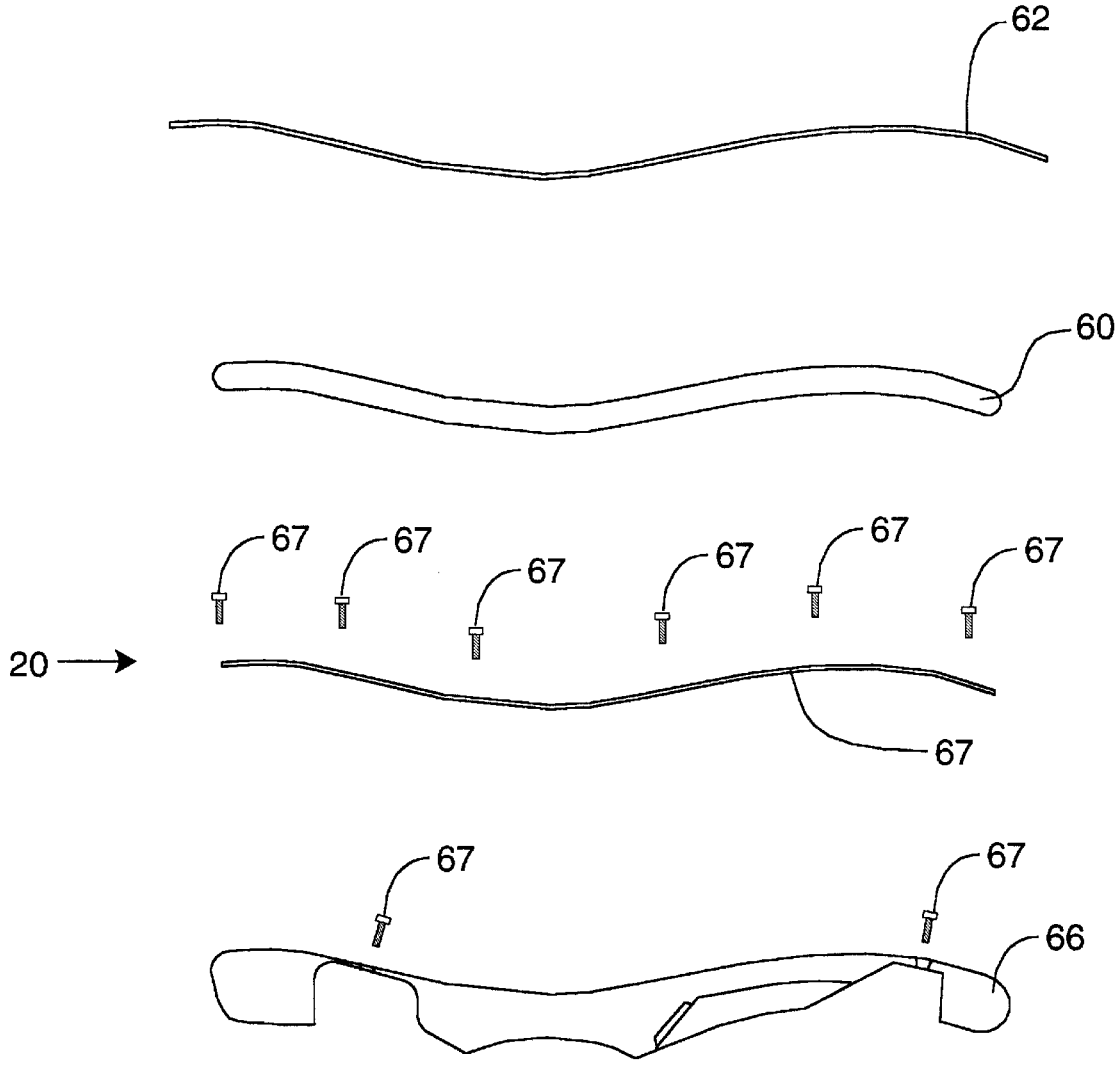
FIG. 4 is an exploded side view of the seat of the present invention.
Figure 5:
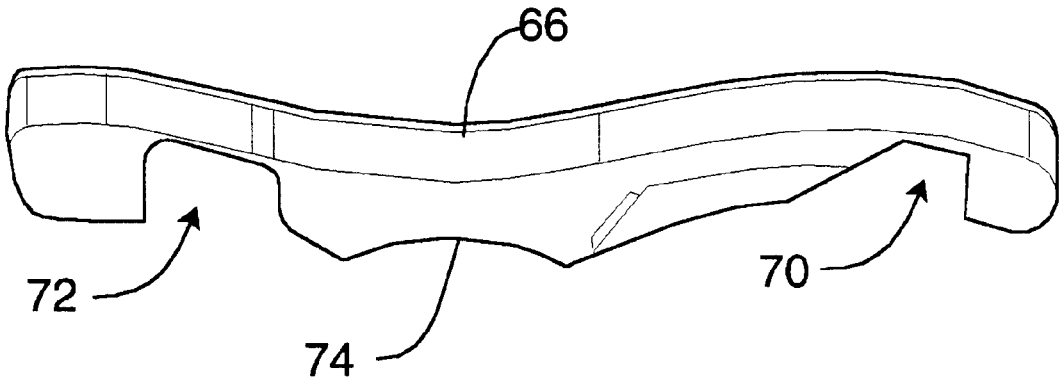
FIG. 5 is a cross-sectional side view of the rigid seat member of the present invention.

As best shown in FIG. 4, the seat 20 of each chair 10 comprises a foam cushion section 60 disposed between a flexible outer covering 62 and an inner backing 64 operatively attached to a rigid seat member 66 by a plurality of fasteners such as rivets each indicated as 67. Each seat 20 is pivotally mounted between the arcuate or convex outer seat support sections 36 of adjacent side frames 12 as described more fully hereinafter.

Figure 6:
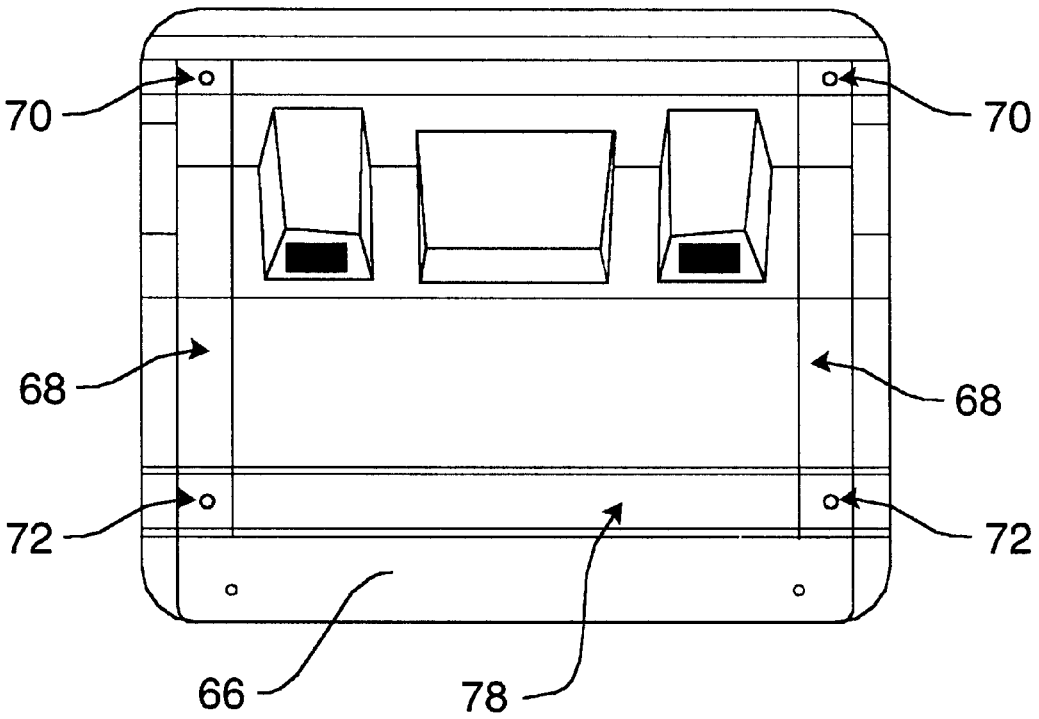
FIG. 6 is a bottom view of the seat of the present invention.

As best shown in FIGS. 4 and 6, the rigid seat member 66 is configured to operatively receive the substantially parallel spaced apart seat positioning members 21 of the corresponding seat positioning assembly as described more fully hereinafter. Each rigid seat member 66 comprises a pair of lateral seat positioning member channels each indicated as 68 terminating in a front seat positioning member recess 70 and a rear seat positioning member recess 72 having an arcuate concave support surface 74 disposed therebetween formed in the bottom surface 76 of the rigid seat member 66 therein and a transverse channel 78 extending between the rear seat positioning member recesses 72 to receive the transverse seat positioning transverse seat positioning counter weight 22.

Figure 7:
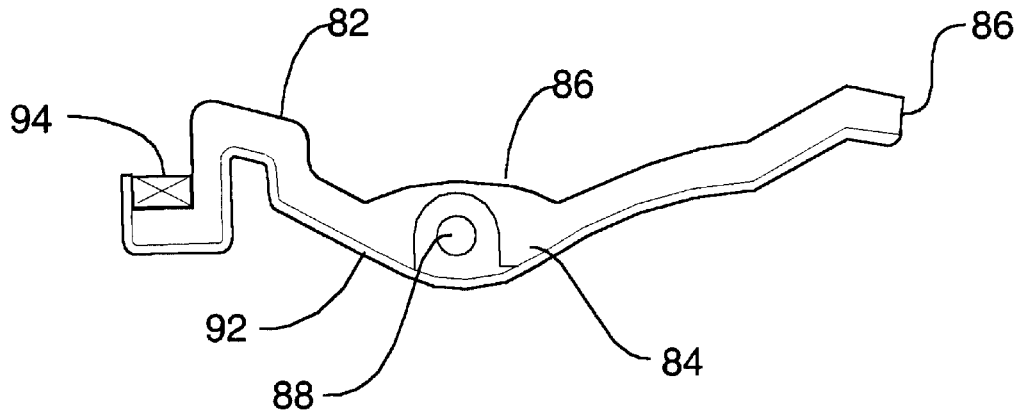
FIG. 7 is a partial side view of the seat positioning member of the present invention.
Figure 8:
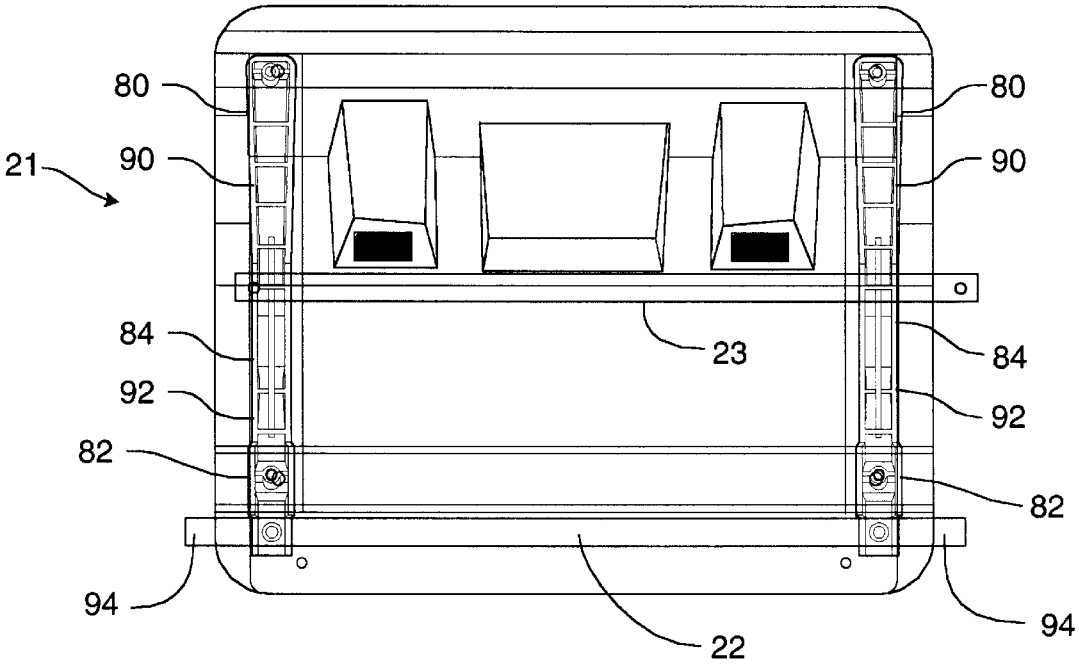
FIG. 8 is a top view of the seat positioning assembly of the present invention.

As best shown in FIGS. 7 and 8, the seat positioning members 21 of each seat positioning assembly comprises a front seat positioning element or protrusion 80 and a rear seat positioning element or protrusion 82 attached to a central element or web 84 including an arcuate or convex upper support surface 86 to engage and support the corresponding arcuate concave support surface 74 and an aperture 88 to receive the support member or rod 23 therethrough by a front interconnecting member 90 and a rear interconnecting member 92 respectively.

The seat positioning assembly further includes a stop or limit member 94 extending outwardly from each side of the seat 20 to engage the arcuate or convex outer seat support section of the seat support member 16 when the seat 20 is in the raised or upright position to engage the substantially horizontal first interconnecting support section 38 of the seat support member 16 when the seat 20 is in the lowered or deployed position. The stop or limit members 94 may be integrally formed in the transverse seat positioning counter weight 22 such as shown in FIG. 8 or may be separate structures extending outwardly from either one or both sides of the seat 20.

When assembled, rows of the chair 10 are closely spaced in front to back relationship as typically found in a stadium or theater. Each row of chair 10 comprises a plurality of such chair 10 in side to side relationship relative to each other.

When the chair 10 are not occupied, the transverse seat positioning counter weight 22 of each seat 20 positioning assembly maintains the corresponding seat 20 in the raised or upright position permitting persons to walk between adjacent rows. When occupied, the weight of the person on the seat 20 overcomes the transverse seat positioning counter weight 22 of corresponding seat positioning assembly to maintain the seat 20 in the lowered or deployed position so long as the chair is occupied. So positioned, the aisle or walkway is relatively obstructed. Once the chair is no longer occupied, the transverse seat positioning counter weight 22 of the corresponding seat positioning assembly causes the corresponding seat 20 to return to the raised or upright position again opening the aisle or walkway for foot traffic.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A chair for use with a plurality of such chairs arranged in rows to provide an aisle between adjacent rows of chairs when the chairs are not in use comprising a frame assembly operatively supporting a seat assembly including a seat movable between a raised position when not in use and a lowered position when in use and a seat positioning assembly coupled to the seat to normally maintain the seat in the raised position, said frame assembly comprises a pair of spaced apart substantially parallel side frames each having an upright frame member with a corresponding seat support member affixed thereto, each said upright frame member comprises a lower stanchion section including an upper portion and an upper stanchion section inclined rearwardly from said upper portion of said lower stanchion section and each said seat support member comprises an arcuate outer seat support section affixed to the front surface of said lower stanchion section by substantially horizontal parallel first and second interconnecting seat support sections extending outwardly from the front surface of said lower stanchion section of said upright frame member.

2. The chair of claim 1 wherein each said lower stanchion section includes at least one mounting tab to secure the corresponding spaced apart substantially parallel side frames to a support structure.

3.The chair of claim 1 wherein said seat positioning assembly further includes a limit member extending outwardly from each side of said seat to engage said arcuate outer seat support section of said seat support member when said seat is in said raised position and to engage said substantially horizontal first interconnecting support section of said seat support member when said seat is in said lowered position.

4. The chair of claim 1 wherein each said lower stanchion section includes a lower and upper mounting tab extending outwardly from the front and rear surfaces respectively of the lower and upper portions respectively thereof to secure the corresponding spaced apart substantially parallel side frames to a support structure.

5. The chair of claim 1 further including a seat support element formed on the inner surface of each said arcuate outer seat support section to pivotally support said seat thereon.

6. The chair of claim 1 further including an arm rest affixed to each said side frame.

7. The chair of claim 6 wherein each said arm rest comprises an arcuate arm rest section affixed to said upright frame member by a first interconnecting arm rest section and to said seat support member by a second interconnecting arm rest section.

8. The chair of claim 1 wherein said seat assembly comprises a back support coupled between the upper portion of each said upright frame member and said seat is pivotally coupled between said seat support members.

9. The chair of claim 8 wherein said back support comprises a foam cushion section disposed between a flexible outer covering and an inner backing operatively attached to a rigid back member by a plurality of fasteners.

10. The chair of claim 8 wherein said seat comprises a foam cushion section disposed between a flexible outer covering and an inner backing operatively attached to a rigid seat member by a plurality of fasteners.

11. A chair for use with a plurality of such chairs arranged in rows to provide an aisle between adjacent rows of chairs when the chairs are not in use comprising a frame assembly operatively supporting a seat assembly including a seat movable between a raised position when not in use and a lowered position when in use and a seat positioning assembly coupled to the seat to normally maintain the seat in the raised position, said seat includes a rigid seat member configured to operatively receive substantially parallel spaced apart seat positioning members of the corresponding seat positioning assembly and said rigid seat member comprises a pair of lateral seat positioning member channels terminating in a front seat positioning member recess and a rear seat positioning member recess having an arcuate concave support surface disposed therebetween formed in the bottom surface of said rigid seat member therein and a transverse channel extending between said rear seat positioning member recesses to receive said seat positioning assembly.

12. A chair for use with a plurality of such chairs arranged in rows to provide an aisle between adjacent rows of chairs when the chairs are not in use comprising a frame assembly operatively supporting a seat assembly including a seat movable between a raised position when not in use and a lowered position when in use and a seat positioning assembly coupled to the seat to normally maintain the seat in the raised position, the seat positioning assembly comprises a transverse seat positioning counterweight and a seat positioning member of each seat positioning assembly comprises a front seat positioning element and a rear seat positioning element attached to a central web including an arcuate upper support surface to engage and support a corresponding arcuate concave surface and an aperture to receive a support member therethrough by a front interconnecting member and a rear interconnecting member respectively.

* * * * *